US006435940B1

(12) United States Patent
Fildan et al.

(10) Patent No.: US 6,435,940 B1
(45) Date of Patent: Aug. 20, 2002

(54) GARMENT HOOK

(75) Inventors: Gerhard Fildan, Vienna; Karl Wanzenböck, Leobersdorf, both of (AT)

(73) Assignee: Fildan Accessories Corporation, Humble, TX (US)

( * ) Notice: Subject to any disclaimer, the term of this patent is extended or adjusted under 35 U.S.C. 154(b) by 33 days.

(21) Appl. No.: 09/737,019

(22) Filed: Dec. 14, 2000

(51) Int. Cl.[7] ..... A41C 3/00

(52) U.S. Cl. ..... 450/86; 450/1; 24/198; 24/200

(58) Field of Search ..... 450/1, 18, 25, 450/26, 28, 64, 63, 86, 88, 93; 2/268, 271, 336, 338, 311–315, 320–323; 24/198, 200, 197

(56) References Cited

U.S. PATENT DOCUMENTS 1,860,170 A * 5/1932 Bronson ..... 24/198
2,040,958 A * 5/1936 Schottenfels ..... 24/198
RE21,619 E * 11/1940 Schottenfels ..... 24/198
2,276,595 A * 3/1942 Shaulson ..... 24/198
2,278,153 A * 3/1942 Shaulson ..... 24/198
2,285,714 A * 6/1942 Hirsh ..... 24/198
2,901,801 A * 9/1959 Girodet ..... 24/198
3,075,268 A * 1/1963 Schwartz ..... 24/198
3,077,650 A * 2/1963 Horne ..... 24/198
3,161,931 A * 12/1964 Zif ..... 24/198
3,218,686 A * 11/1965 Rubenstein ..... 24/198
3,529,329 A * 9/1970 Burleson ..... 24/198
4,457,051 A * 7/1984 Bartolini ..... 24/198

* cited by examiner

*Primary Examiner*—Gloria M. Hale
(74) *Attorney, Agent, or Firm*—Herbert Dubno

(57) ABSTRACT

A transparent garment hook has a semicircular bight from which a hook arm and a loop arm extend. Inwardly of this bight there is a reduced thickness web which defines the T section with the bight resisting cracking.

14 Claims, 6 Drawing Sheets

FIG. 7
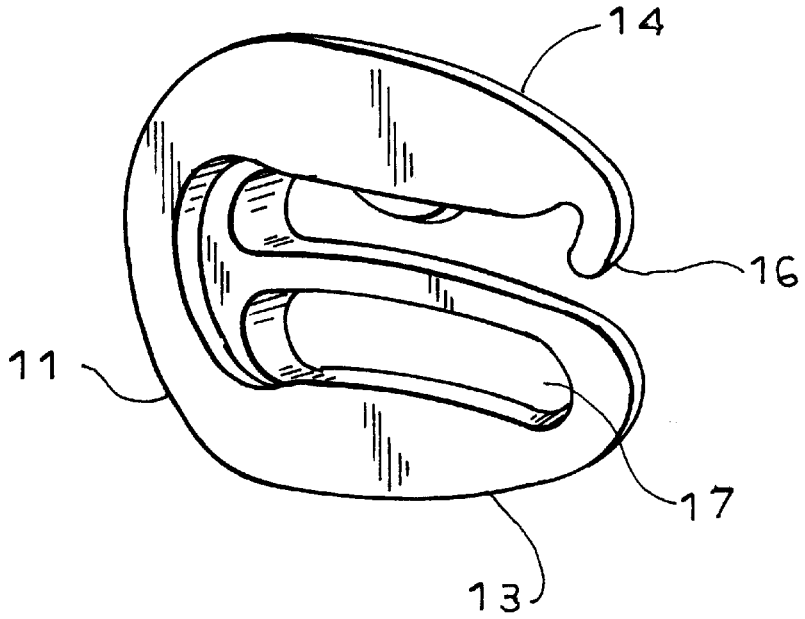
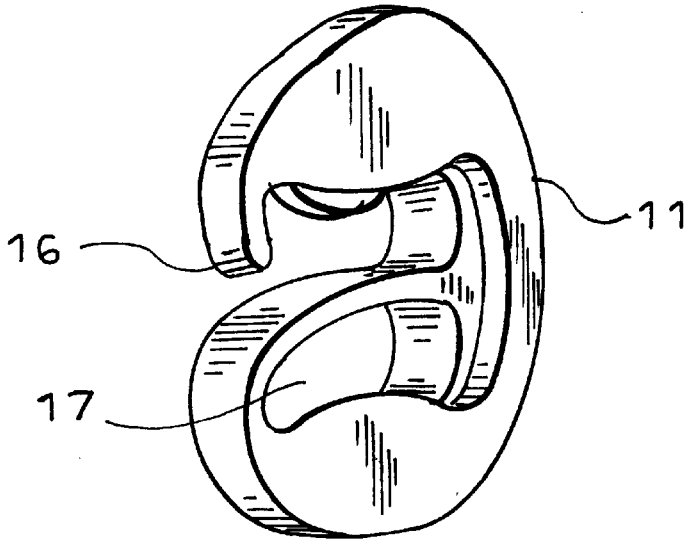
FIG. 8

FIG. 9
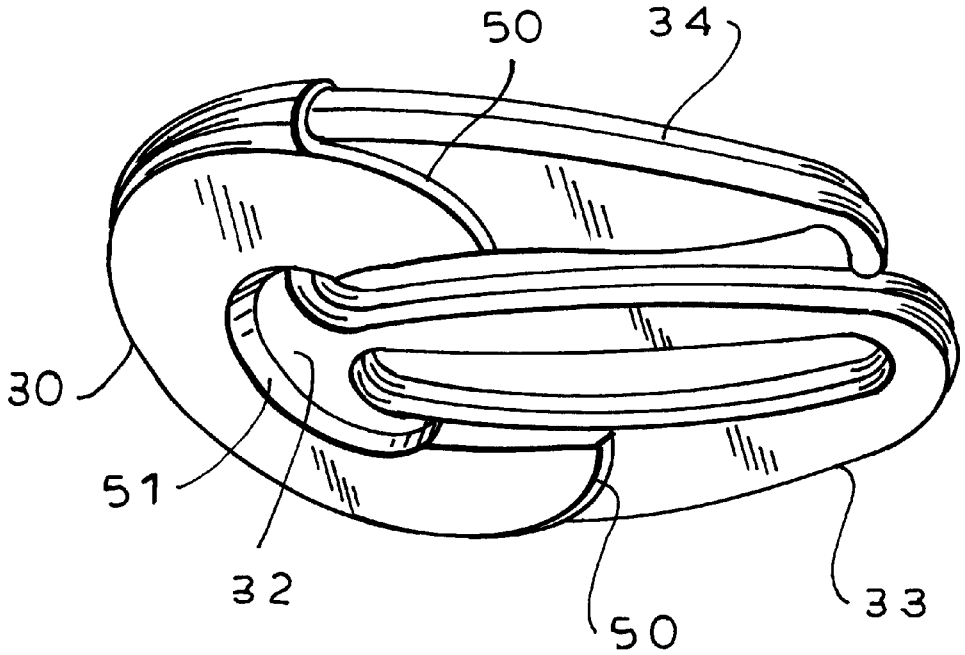
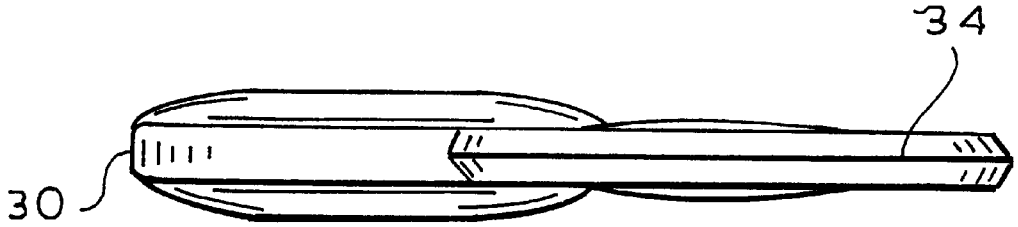
FIG. 11

GARMENT HOOK

FIELD OF THE INVENTION

Our present invention relates to a garment hook, especially a transparent garment hook for use with lingerie, swimsuits and other garments in which a strap is to be connected to another part of the garment. More particularly, the invention relates to a garment hook of the type which has an eye through which a strap can be looped and a hook which is engageable with the aforementioned other part of the garment.

BACKGROUND OF THE INVENTION

Garment hooks of the type mentioned are widely used in lingerie, undergarments, brassieres and swimsuits and wherever it may be necessary to releasably engage a strap with another part of the garment. Such garment hooks can have an eye through which the strip is looped and a hook which is inserted through some opening in the garment, e.g. another strap or a loop formed in a fabric piece integral with or attached to the garment and in which the fastener is retained by the hook end which can project beyond that fabric loop.

Garment hooks of this type are frequently bulky, insufficiently strong and unsightly. If injection molded, for example, from a synthetic resin they have a tendency to crack where the hook adjoins the body of the fastener and in many cases, the stress to which the hook is subjected can form stress cracks at the junction of the hook with the body and which, even if they do not lead to breakage, are unsightly, especially if the fastener is fabricated in a transparent material.

In modern fashion, it is frequently desirable to fabricate such fasteners from transparent material and hence the problem has become especially pronounced with more modern lingerie, brassieres and swimsuits.

OBJECTS OF THE INVENTION

It is the principal object of the present invention to provide a fastener, e.g. a garment hook, especially for lingerie, brassieres and swimsuits, whereby the drawbacks mentioned previously are obviated and the fastener is strong, free from cracks which may render the fastener unsightly and is easy to use.

Another object of the invention is to provide a garment hook for the purposes described which has a relatively slim appearance but nevertheless has high strength and can be employed without bunching up of the straps or other garment parts to which the fastener is applied.

SUMMARY OF THE INVENTION

These objects and others which will become apparent hereinafter are attained, in accordance with the invention, in a garment hook which comprises a hook body of a synthetic resin material formed with a bight, a loop arm extending from the bight and a hook arm juxtaposed with the loop arm, the loop arm being formed with an elongated eye adapted to receive a strap of a garment, the hook arm being formed with a hook at an end thereof opposite the bight, the hook arm defining an elongated gap with the loop arm whereby the hook arm is insertable through an opening in the garment, the bight being substantially semicircular and the arms at ends opposite the bight being thinner than the bight.

The garment hook of the invention can have its arms form thickness steps with the bight or arms which taper continuously from the bight to the ends of the arms opposite the bight. The bight can be of substantially trapezoidal outwardly tapering cross section and, as noted, the body can be substantially transparent and is preferably composed of a polycarbonate.

An important feature of the invention is that the cross section of the body at the bight is T-shaped. To this end, the gap and the eye can terminate proximal to the bight in a web of a thickness less than that of the bight and forming the shank of the T-section whose head is the bight itself. We have found that when the hook arm is curvilinearly convex toward the loop eye and the eye is defined between two longitudinal edges which are also convex toward the hook arm, the strap and the other garment part are evenly distributed or centered in the gap and in the eye and do not tend to bunch at either end of the gap or the eye. Preferably the hook arm also has a bulge substantially midway of its length and projecting toward the loop arm.

BRIEF DESCRIPTION OF THE DRAWING

The above and other objects, features, and advantages will become more readily apparent from the following description, reference being made to the accompanying drawing in which:

FIGS. 6, 7 and 8 are perspective views from various sides of this fastener;

FIG. 9 is a perspective view of another garment hook embodying the invention;

FIG. 11 is a top view of this garment hook; and

SPECIFIC DESCRIPTION

Figure 1:
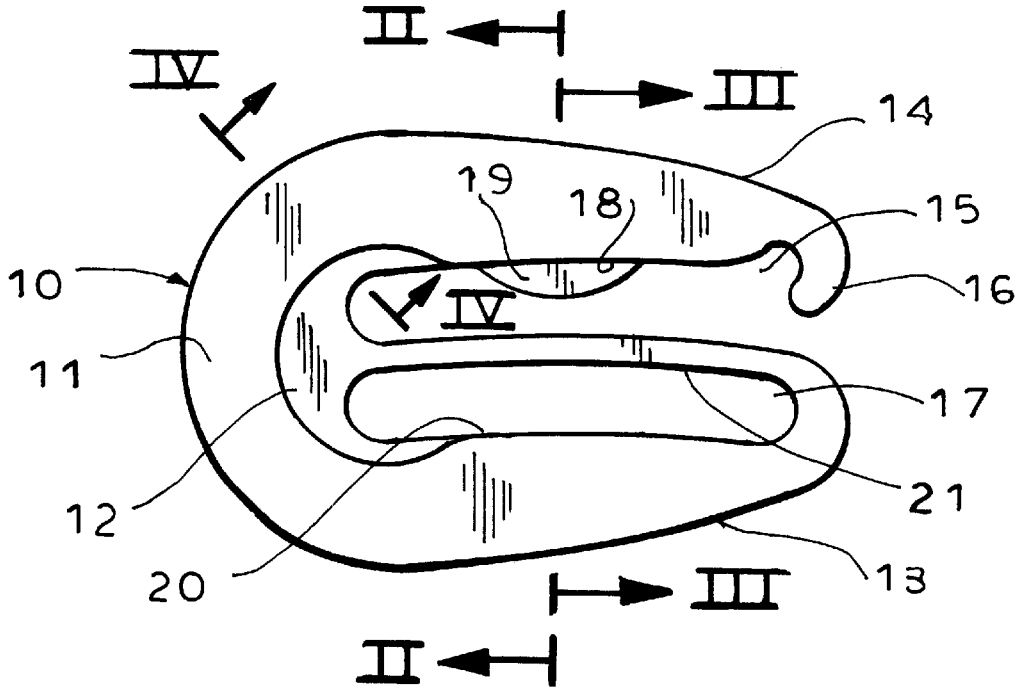
FIG. 1 is an elevational view of a garment hook according to the invention.
Figure 2:
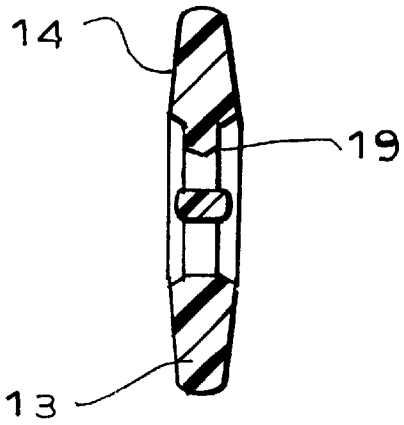
FIG. 2 is a section taken generally along the line II—II of FIG. 1.
Figure 3:
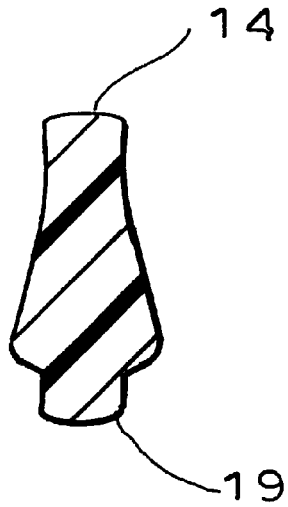
FIG. 3 is a section taken generally along the line III—III of FIG. 1.
Figure 6:
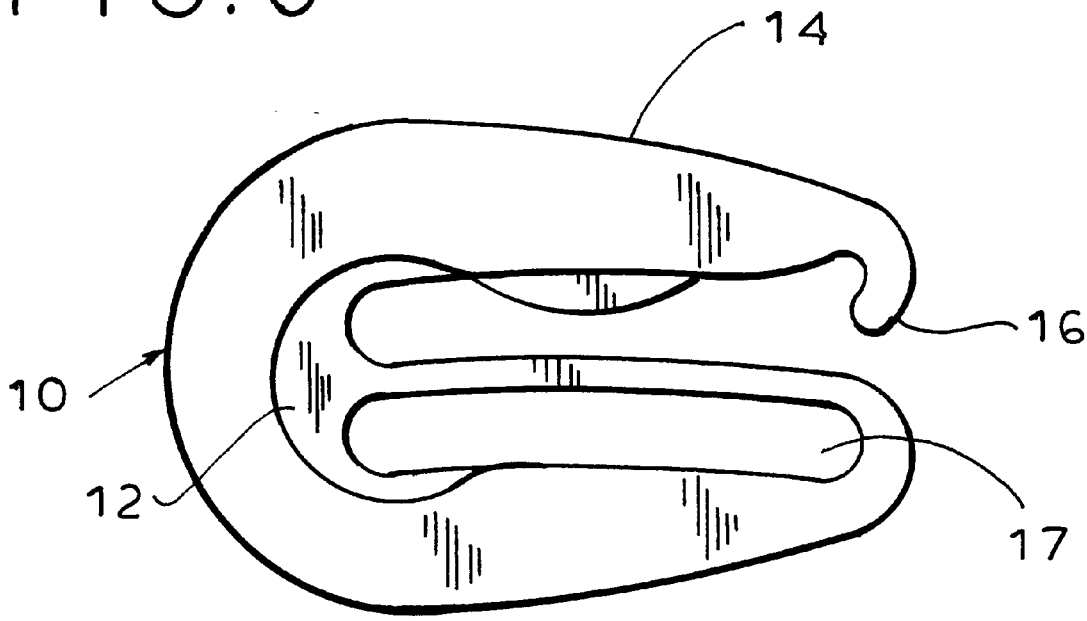
Figure 4:
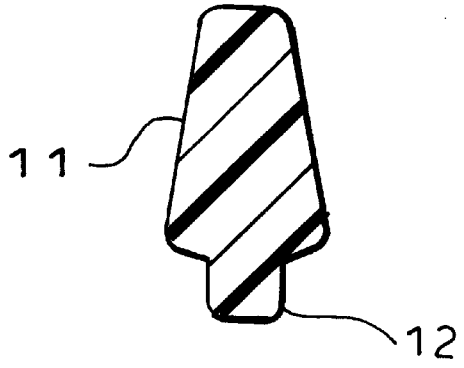
FIG. 4 is a section taken generally along the line IV—IV of FIG. 1 showing the T section.
Figure 5:
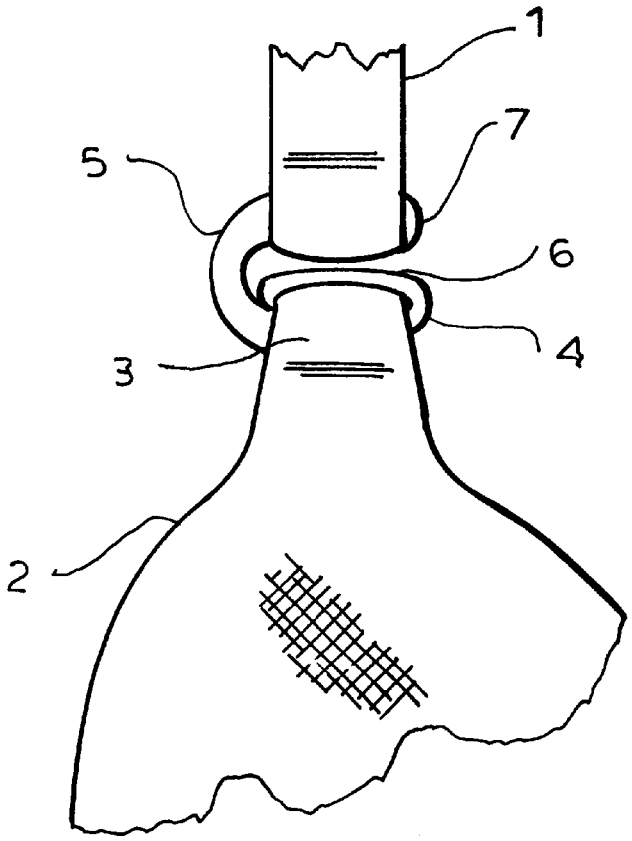
FIG. 5 is an elevational view showing the use of the hook for a brassiere or the top of a swimsuit.
Figure 10:
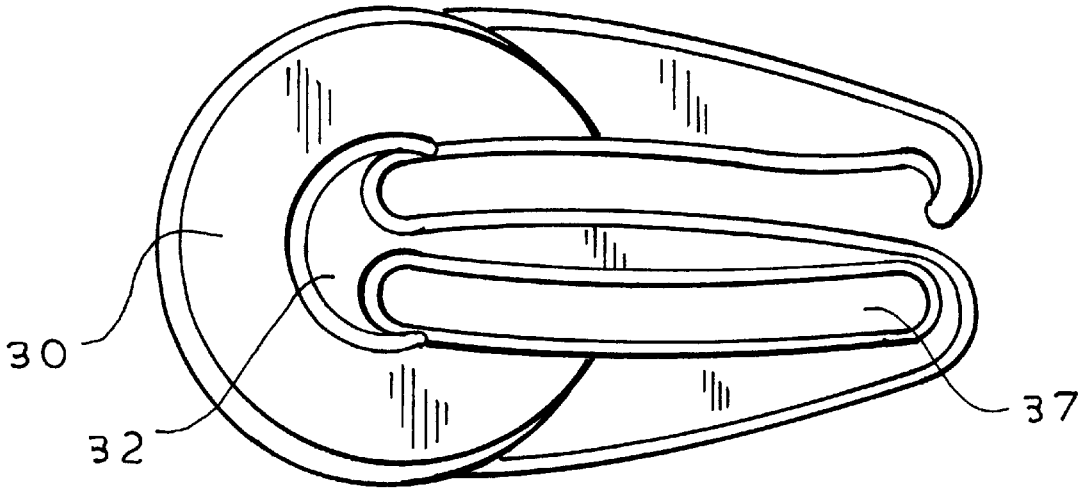
FIG. 10 is an elevational view of the latter hook.
Figure 12:
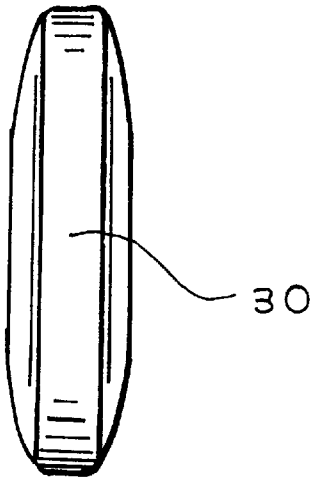
FIGS. 12 and 13 are end views of this hook from opposite ends.
Figure 13:
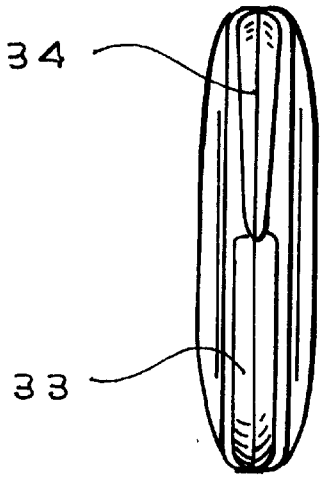

In FIGS. 1–8 of the drawing we have shown an embodiment of the garment hook of the invention which can be utilized as illustrated in FIG. 5, for example, between a strap 1 and another garment part 2, for example, the cup of a brassiere or swimsuit garment. To this end, the garment can be provided with a loop 3 into which the hook arm 4 of the fastener 5 can be inserted and in which the hook arm is held by the hook formation 6. The strap 1 is passed through an eye 7 in the fastener.

FIGS. 1–4 and 6–8 show the preferred construction of the fastener 10 and in this construction, the bight 11 is substantially semicircular and has along its inner periphery a web 12 which is thinner than the bight (see FIG. 4) so that a T cross section is thereby provided. The garment hook comprises a loop arm 13 and a hook arm 14 defining a gap 15 between them, this gap terminating at one end in the hook formation 16 and at the other end in the web 12. The loop arm 13 is formed with an elongated eye 17 adapted to receive the strap as has been described. The edge 18 of the hook arm turned to the loop arm is curvilinearly convex in the direction of the loop arm and is formed with a bulge 19 substantially midway of its length. The bulge can also be seen in FIGS. 2 and 3.

The slot 17 is delimited by two longitudinal edges 20 and 21 which are also convex but toward the hook arm 14. The convex edges assist in centering the strap and the garment portion engaged by the hook in the slot or gap so that the fabric does not bunch toward either end. As can be seen from FIG. 4, the bight 11 has a trapezoidal cross section and tapers outwardly. From FIGS. 2 and 3 it will be apparent that the arms 13 and 14 likewise have trapezoidal cross sections and taper outwardly. The arms in addition, taper toward their free ends away from the bight 10 and the entire body formed by the bight, the web and the arm is injection-molded in one piece from a transparent polycarbonate synthetic resin.

In the embodiment of FIGS. 9–13, the arms 33 and 34 are connected by steps 50 with the bight 30 and the web 32 forming the T section with the bight is located inwardly of the step 51. The slot 37 in this hook is of a somewhat different shape from that of the hook of FIGS. 1–8 but otherwise the principles described are applicable here as well.

For the embodiment of FIGS. 1–8, the overall thickness of the body can be 2.11 mm, the gap and the slot can have a length of say 11.5 mm, the overall length of the garment hook can be 17.3 mm and the overall width can be 11.1 mm. These values are given only for illustrative purposes since the size of the garment hook will depend upon the styling of the garment and the width of the straps.

We claim:

1. A garment hook comprising a hook body of a synthetic resin material formed with a bight, a loop arm extending from said bight and a hook arm juxtaposed with said loop arm, said loop arm being formed with an elongated eye adapted to receive a strap of a garment, said hook arm being formed with a hook at an end thereof opposite said bight, said hook arm defining an elongated gap with said loop arm whereby said hook arm is insertable through an opening in said garment, said bight being substantially semicircular and said arms at ends opposite said bight being thinner than said bight.

2. The garment hook defined in claim 1 wherein said arms form thickness steps with said bight.

3. The garment hook defined in claim 1 wherein said arms taper continuously from said bight to said ends of said arms opposite said bight.

4. The garment hook defined in claim 1 wherein said bight is of substantially trapezoidal outwardly tapering cross section.

5. The garment hook defined in claim 1 wherein said body is substantially transparent.

6. The garment hook defined in claim 5 wherein said body is composed of a polycarbonate.

7. The garment hook defined in claim 1 wherein said gap and said eye terminate proximal to said bight in a web of a thickness less than that of said bight whereby said body has a generally T-shaped cross section at said web.

8. The garment hook defined in claim 1 wherein said hook arm is curvilinearly convex toward said loop arm and said eye has two longitudinal edges convex toward said hook arm.

9. The garment hook defined in claim 8 wherein said hook arm is formed with a bulge projecting toward said loop arm and substantially midway along said hook arm.

10. The garment hook defined in claim 9 wherein said arms taper continuously from said bight to said ends of said arms opposite said bight.

11. The garment hook defined in claim 10 wherein said bight is of substantially trapezoidal outwardly tapering cross section.

12. The garment hook defined in claim 11 wherein said body is substantially transparent.

13. The garment hook defined in claim 12 wherein said body is composed of a polycarbonate.

14. The garment hook defined in claim 13 wherein said gap and said eye terminate proximal to said bight in a web of a thickness less than that of said bight whereby said body has a generally T-shaped cross section at said web.

* * * * *